US006269875B1

(12) United States Patent
Harrison, III et al.

(10) Patent No.: US 6,269,875 B1
(45) Date of Patent: Aug. 7, 2001

(54) CHEMICAL STICK STORAGE AND DELIVERY SYSTEM

(75) Inventors: William G. Harrison, III; Stephen G. Fulton; James Meaders, all of Wichita Falls, TX (US)

(73) Assignee: The Harrison Investment Trust, Wichita Falls, TX (US)

( * ) Notice: Subject to any disclaimer, the term of this patent is extended or adjusted under 35 U.S.C. 154(b) by 0 days.

(21) Appl. No.: 09/505,993

(22) Filed: Feb. 17, 2000

Related U.S. Application Data

(63) Continuation-in-part of application No. 09/081,682, filed on May 20, 1998, now Pat. No. 6,044,905.
(60) Provisional application No. 60/047,355, filed on May 21, 1997.

(51) Int. Cl.[7] ..... E21B 33/068; E21B 34/02
(52) U.S. Cl. ..... 166/53; 166/66; 166/75.15
(58) Field of Search ..... 166/53, 65.1, 66, 166/70, 75.15, 309, 310, 311; 137/268

(56) References Cited

U.S. PATENT DOCUMENTS

| | | | | |
|---|---|---|---|---|
| 2,760,584 | | 8/1956 | Rohrback . | |
| 2,773,551 | | 12/1956 | Warden et al. . | |
| 3,160,210 | | 12/1964 | Brewer . | |
| 4,611,664 | * | 9/1986 | Osterhoudt, III et al. | 166/310 X |
| 4,665,981 | | 5/1987 | Hayatdavoudi . | |
| 4,785,880 | | 11/1988 | Ashton . | |
| 5,188,178 | | 2/1993 | Noyes . | |
| 5,205,359 | * | 4/1993 | Stephenson | 166/53 X |
| 5,515,924 | | 5/1996 | Osterhoudt . | |
| 5,590,713 | * | 1/1997 | Baugh et al. | 166/53 |
| 5,813,455 | | 9/1998 | Pratt et al. . | |
| 6,044,905 | * | 4/2000 | Harrison, III | 166/75.15 |
| 6,056,058 | * | 5/2000 | Gonzalez | 166/310 |
| 6,182,765 | * | 2/2001 | Kilgore | 166/53 X |

* cited by examiner

*Primary Examiner*—George Suchfield
(74) *Attorney, Agent, or Firm*—Nixon Peabody LLP; Daniel W. Sixbey

(57) ABSTRACT

The chemical stick storage and delivery system includes a chemical stick delivery tube in communication with a well which supports a rotatable chemical stick storage device on the uppermost end of the delivery tube. The delivery tube includes an upper opening and the chemical stick storage device rotates to position chemical sticks sequentially over the delivery tube opening. Within the delivery tube is a first valve positioned directly beneath the delivery tube opening and a second valve spaced below the first valve for a distance sufficient to form a chamber between the first and second valves to receive a chemical stick. A central processor unit controls the operation of the first and second valves so that the first valve is opened while the second valve is closed and the chamber is brought to well head pressure before the second valve is opened to drop the chemical stick from the chamber into the well.

20 Claims, 5 Drawing Sheets

FIG. 4
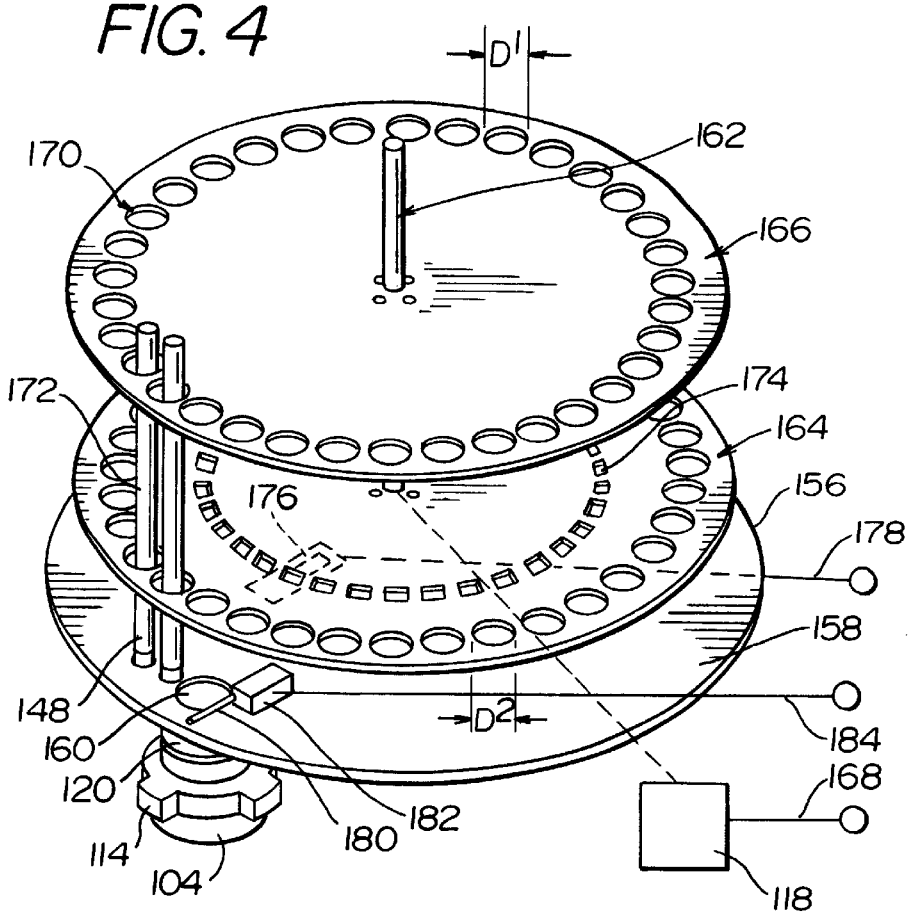
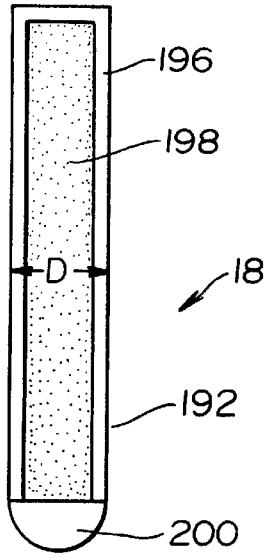
FIG. 5

CHEMICAL STICK STORAGE AND DELIVERY SYSTEM

This application is a continuation-in-part application of U.S. application Ser. No. 09/081,682 filed May 20, 1998, now U.S. Pat. No. 6,044,905, which claims priority to Provisional application Serial No. 60/047,355 filed May 21, 1997.

BACKGROUND OF THE INVENTION

In the production of natural gas from oil and gas wells, a problem develops when water comes into the well from the producing formation and begins to exert a back pressure (due to the hydrostatic head of the water column) against the producing formation. This back pressure rises in direct proportion to the height of the water and its density.

The most popular procedure to remove this water is to drop soap sticks into the well to foam the water. This foamed water begins to reduce back pressure on the formation as it is formed and this in turn allows more gas to enter the well and to create more foamed water. This eventually exits the well at the surface. Slowly this water begins to build up again and more sticks are dropped by hand into the well on a daily basis. Other applications include the regular insertion of corrosion Inhibitor sticks, Scale Removing sticks, Paraffin Inhibitor, etc.

SUMMARY OF THE INVENTION

The purpose of this invention is to allow the oil and gas company field people to load a launching device with one or more sticks and to drop these sticks under the control of a controller. This is a big advantage for the oil and gas company due to the following:

1. Less trips by field people to insert sticks in well.
2. More productive wells because the water is kept at a low level allowing greater gas production.
3. Some wells are not accessible in poor weather conditions.
4. More productive field personnel saving them many hours per month which can be devoted to other work.

This purpose is achieved by providing a chemical stick delivery tube in communication with a well which supports a rotatable chemical stick storage device on the uppermost end of the delivery tube. The delivery tube includes an upper opening which opens into the chemical stick storage device and the chemical stick storage device rotates to position specially designed chemical sticks sequentially over the delivery tube opening. Within the delivery tube is a first valve positioned directly beneath the delivery tube opening and a second valve spaced below the first valve for a distance sufficient to form a chamber between the first and second valves to receive a chemical stick. A controller, such as a central processing unit or a timing device controls the operation of the first and second valves so that after the first valve is opened while the second valve is closed to drop a chemical stick into the chamber, the first valve is then closed and a fill valve is opened to equalize the pressure between the well head and the chamber so that the chemical stick can drop from the chamber into the well. Once pressure is equalized, the fill valve is closed and the second valve is opened to drop the chemical stick into the well.

BRIEF DESCRIPTION OF THE DRAWINGS

FIG. 4 is a perspective view of the stick delivery unit of FIG. 3;

FIG. 5 is a sectional view of a chemical stick used in the stick delivery unit of FIG. 4.

DESCRIPTION OF THE PREFERRED EMBODIMENTS

Figure 1:
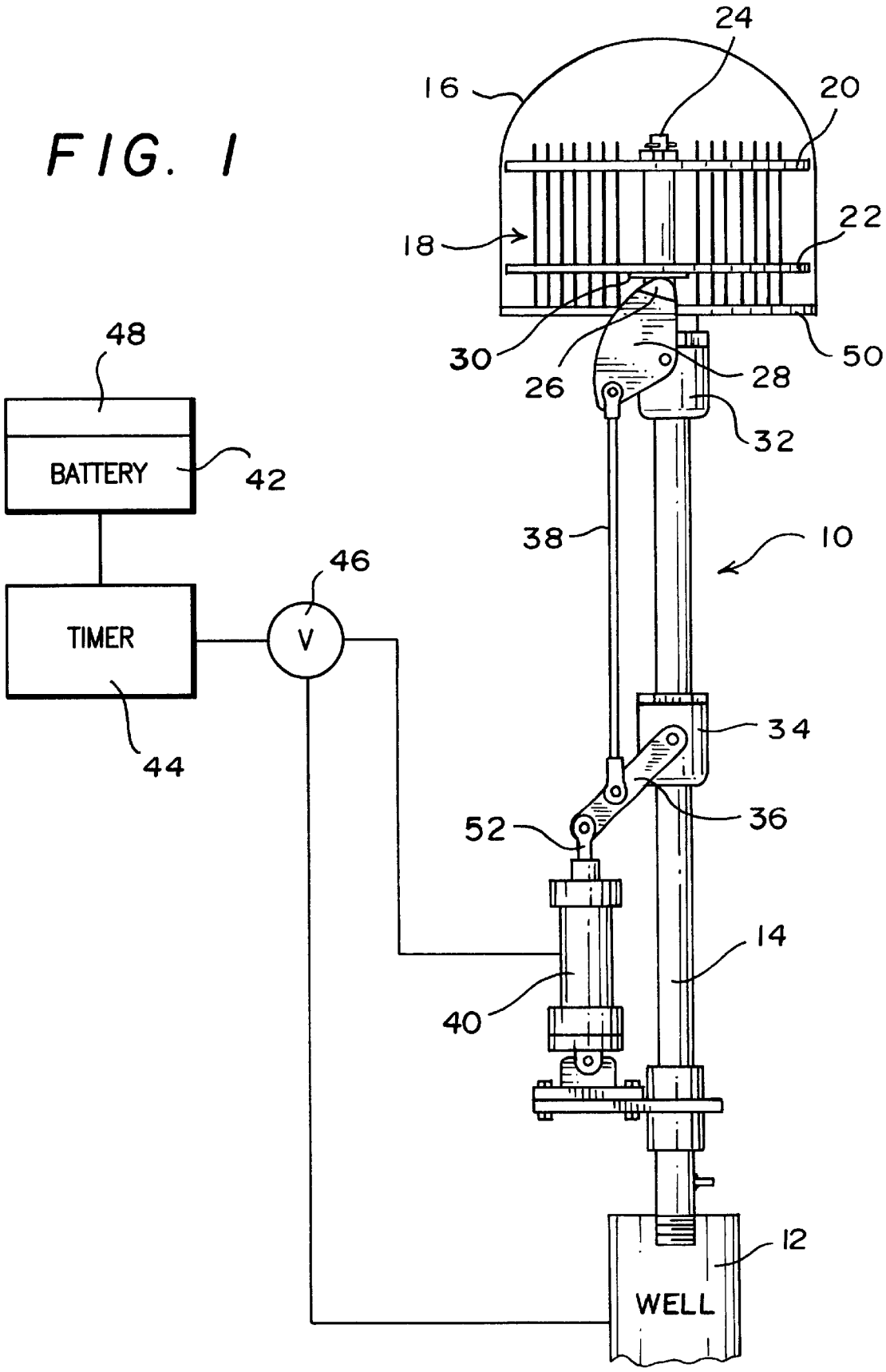
FIG. 1 is diagrammatic illustration of the chemical stick storage and delivery system of the present invention.

Referring to the drawing, the chemical stick storage and delivery system indicated generally at 10 is mounted on the well head of a well 12. This chemical stick storage and delivery system includes a delivery tube 14 having one end opening into the well, and the opposite end supporting a chemical stick storage dome 16. The delivery tube 14 opens into the bottom of the storage dome 16 to receive chemical sticks 18 which are stored in the storage dome. These sticks are loosely mounted in holes 17 and 19 formed in upper and lower rotatable plates 20 and 22 respectively which are joined to rotate on and with a central shaft 24 within the storage dome. The plates are designed to position each of the chemical sticks in sequence over the open end of the delivery tube 14 so that the sticks can drop into the delivery tube. Plates 20 and 22 are rotated in a step wise manner by a ratchet 26 formed on an upper valve operator 28. This ratchet engages a gear 30 on the bottom of the lower plate 22 to rotate the upper and lower plates about the central shaft 24. For each operation of the ratchet, a new chemical stick is positioned over the delivery tube 14.

The upper valve operator 28 is mounted on the housing of an upper valve 32 which opens and closes the upper end of the delivery tube 14. A lower valve 34 also operates to open and close the delivery tube 14 and includes a valve operator 36. When the upper valve 32 is closed, the lower valve 34 is opened and when the upper valve 32 is opened, the lower valve 34 is closed. The upper and lower valve operators are connected by a link 38, which operates the two valves simultaneously and causes one to close as the other opens. This is accomplished by means of a hydraulic cylinder 40 which is connected to raise or lower the lower valve operator 36.

A twelve volt battery 42 provides power to a timer 44 which operates a solenoid valve 46. When the valve 46 opens, a small amount of gas from the well 12 or air or gas from another source is provided to operate the hydraulic cylinder 40. In the field, the battery 42 is recharged by a solar panel 48.

In the operation of the chemical stick storage and delivery system 10, chemical sticks such as soap sticks, corrosion, inhibitor sticks, scale removing sticks or paraffin inhibitor sticks are inserted into the holes of the upper and lower plates 20 and 22 and rest against the bottom wall 50 of the circular dome 16. The timer 44 is then set for the time to be expended between stick drops, and the timer cycle is initiated. When a drop time occurs, the timer 44 provides power to open the solenoid valve 46 so that gas or air is provided to the hydraulic cylinder 40. This causes the cylinder to extend a piston 52 which moves the lower valve operator 36 upwardly to close the lower valve 34. At the same time, the connecting link 38 moves the upper valve operator 28 upwardly to open the upper valve 32 and permit a chemical stick to drop into the delivery tube 14. Subsequently, the timer 44 removes power from the solenoid valve 46 causing it to vent the cylinder 40 and lower the piston 52. As the piston lowers, the lower valve actuator 36 opens the lower valve 34 to drop the stick into the well 12, and as the upper valve actuator 28 is lowered to close the upper valve 32, the ratchet 26 pivots the upper and lower plates 20 and 22 to position another chemical stick 18 over the end of the delivery tube 14. The timer now begins a subsequent timing process.

Figure 2:
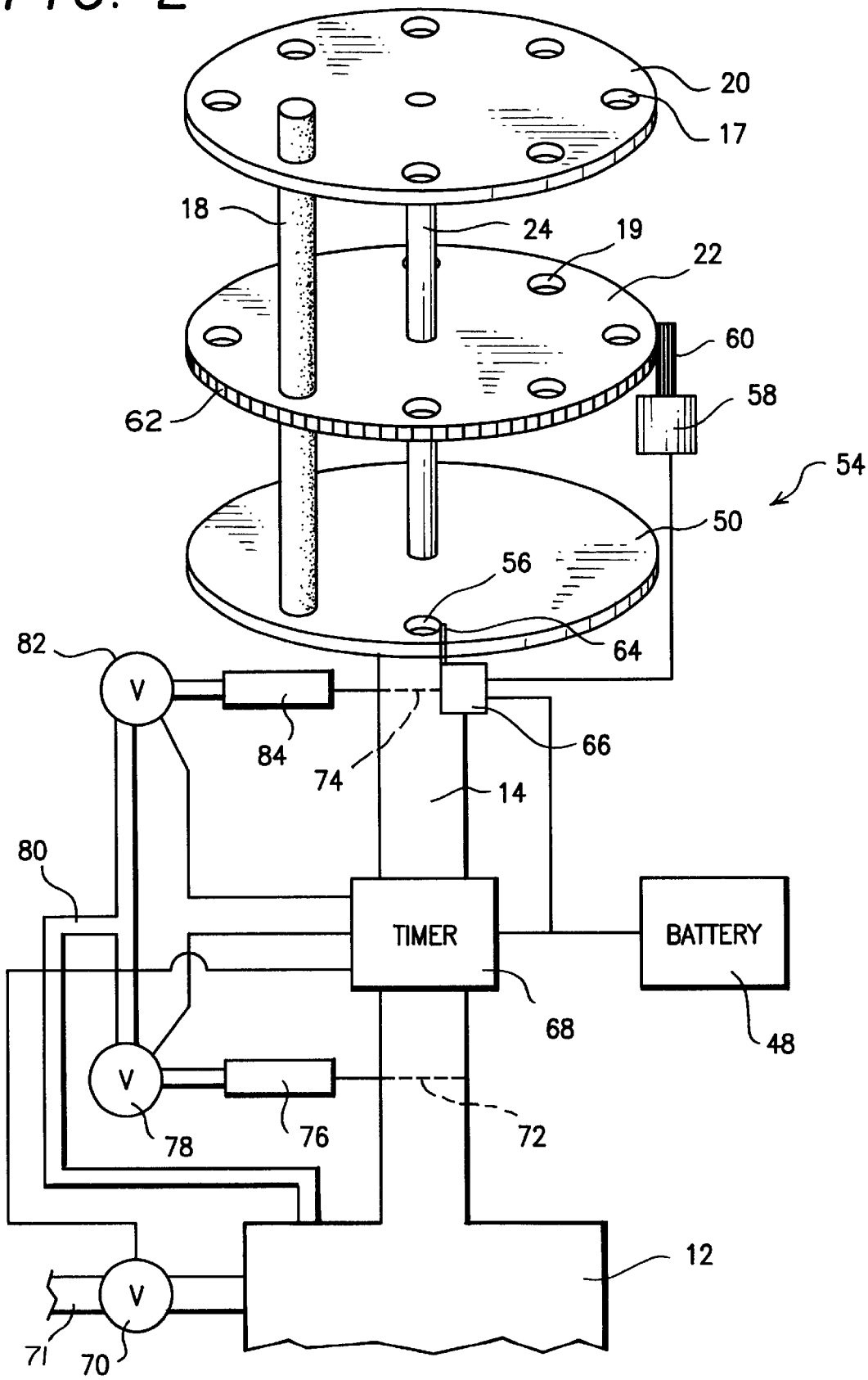
FIG. 2 is a diagrammatic illustration of a second embodiment of the chemical stick storage and delivery system of the present invention.

A second embodiment of the stick storage and delivery system is illustrated at 54 in FIG. 2 where the same reference numerals used in FIG. 1 are used to designate elements having the same function and structure. Here, the shaft 24 is rotatably supported by the bottom wall 50 which is secured to the upper end of the delivery tube 14. In FIG. 2, the opening into the delivery tube is illustrated at 56.

A stepper motor 58 drives a gear 60 which engages a gear 62 formed on the edge of the plate 22 to rotate the plates 20 and 22 and the shaft 24. As a chemical stick 18 is moved into position over the opening 56, it engages the actuator 64 of a delay switch 66 to cause the delay switch to open so that power to the stepper motor 58 is cut off. Once the chemical stick drops into the delivery tube, the delay switch again closes after a delay period (i.e. 30 seconds) to again complete the power circuit from the battery 48 to the stepper motor.

A timer 68 controls the operation of the stick storage and delivery system. At preset timed intervals when a stick is to be delivered, the timer provides power from the battery 48 to an electrically operated flow purge valve 70 to shut down the well output line 71. At the same time, the timer insures that a bottom valve 72 within the delivery tube is closed so that gas cannot escape through the delivery tube when a top valve 74 is opened. If the bottom valve is an electrically operated normally closed valve, the timer provides no power to open the valve so that it remains closed. If, however, the lower valve is operated by a hydraulic cylinder and piston 76, the timer 68 provides power from the battery to open a solenoid valve 78 so that gas pressure from the well over a line 80 is fed to the hydraulic cylinder and piston 76 to insure closure of the lower valve 72. A second solenoid valve 82 remains open to provide gas flow over the line 80 to a hydraulic cylinder and piston 84 which operates the top valve 74 to maintain this valve closed. When a delay period (i.e. 30 seconds) has elapsed after the closure of the valve 70, the timer operates the valve 82 to close, blocking gas from the line 80 and to vent the hydraulic cylinder and piston 84 to cause it to open the top valve 74. Now the chemical stick which was positioned over the opening 56 will drop into the delivery tube 14 and rest on the lower valve 72. This releases the actuator 64 of the delay switch 66, but the delay switch does not close the power circuit to the stepper motor 58 until a delay period has elapsed.

During the delay period determined by the delay switch 66, the timer 68 opens the valve 82 causing the hydraulic cylinder and piston 84 to close the top valve 74. With the top valve closed, the timer closes the valve 78 to block gas from the line 80 and to vent the hydraulic cylinder and piston 76 to open the lower valve 72. Now gas pressure from the well will equalize in the delivery tube below the closed top valve 74 causing the chemical stick in the delivery tube to drop into the well.

The timer 68 now completes the cycle by opening the valve 70 and the valve 78 to again close the lower valve 72. The stepper motor 58 will be energized through the delay switch 66 to move another chemical stick over the opening 56 and into contact with the actuator 64 to open the delay switch. Then, after a preset time interval has elapsed, the timer 68 will again initiate the cycle to drop a chemical stick into the well.

It is obvious that the line 80 can be connected to a liquid or gas source other than the well gas to operate the hydraulic cylinders and pistons 76 and 84. Also, the upper and lower valves 74 and 72 can be normally closed electrically operated solenoid valves which are energized to open and deenergized to close in the described manner by the timer 68.

Figure 3:
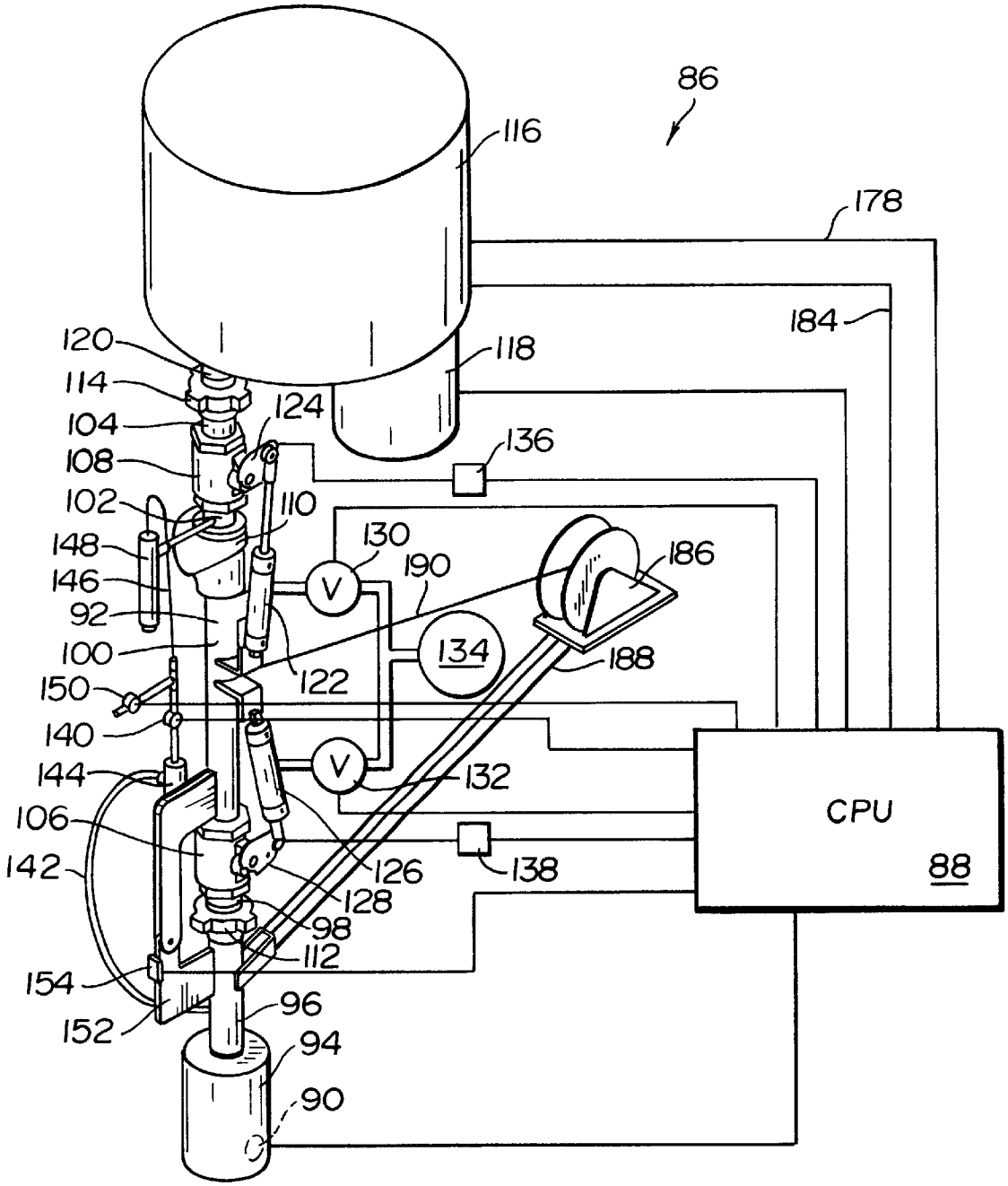
FIG. 3 is a perspective view of a third embodiment of the chemical stick storage and delivery system of the present invention.

For many applications, it may not be desirable to have the chemical stick storage and delivery system operate in response to a preset timed schedule, as variable well conditions may require the application of a chemical stick at different intervals. Often, a central processor unit connected to well sensors receives data indicative of well conditions. Many oil field systems now include a plurality of wells controlled by a central computer which receives well data and transmits control signals by radio transmission or telemetry. The chemical stick storage and delivery system 86 of FIGS. 3 and 4 is designed to operate under the control of a central processor unit 88 connected to receive well condition data from well sensors represented by the sensor 90. The central processor unit 88 can constitute a stand alone microprocessor directly connected to control elements of the chemical stick storage and delivery system, as illustrated in FIG. 3, and for this application, the microprocessor would be powered by a battery 42 and solar panel 48 of the type shown in FIG. 1. The microprocessor can be connected to transmit data to a remote well logging unit.

Alternatively, the control processor unit can be a remote computer operative to control a plurality of wells. In this case, instead of the direct connections shown in FIG. 3, the central processor unit sends control signals and receives input data by radio transmission or telemetry to control components of the chemical stick storage and delivery system 86 in the field, which components are battery powered. However, for purposes of description only, the operation of the chemical stick storage and delivery system 86 will be described as being under the control of a directly connected central processor unit 88 with the understanding that these direct connections can be replaced by wireless connections to a remote processor unit.

The chemical stick storage and delivery system 86 includes an elongate delivery tube 92 mounted on a well head 94. The delivery tube 94 is formed by interconnected tubular sections 96, 98, 100, 102 and 104, and a lower valve 106 is connected between the tubular sections 98 and 100 while an upper valve 108 is connected between the tubular sections 102 and 104. A normally open one way check valve 110 is connected between tubular sections 100 and 102, and a hammer union disconnect 112 joins tubular sections 96 and 98. A second hammer union disconnect 114 mounts an enclosed turret housing unit 116 and drive motor 118 on the tubular section 104 over the open end 120 of the delivery tube 94.

A double action air cylinder and piston 122 is connected to a valve actuator 124 to selectively open or close the upper valve 108, while a second double action air cylinder and piston 126 is connected to a valve actuator 128 to open or close the lower valve 106. The double action air cylinder and pistons 122 and 126 are mounted on the tubular section 100 and receive air by means of solenoid valves 130 and 132 respectively from a compressed air source 134. Alternatively, the double action air cylinders and pistons can receive pressurized gas from the well head as shown in FIG. 1. A sensor switch 136 senses whether the upper valve 108 is open or closed and transmits this data to the central processor unit 88, and a sensor switch 138 operates to sense whether the lower valve 106 is open or closed and to transmit this data to the central processor unit.

The central processor unit is connected to control a fill valve 140 which controls the passage of gas from the well head through a line 142, a filter 144, a line 146 and a filter 148 to the tubular section 102. Similarly, the central processor unit is connected to control a bypass valve 150 connected between the line 146 and atmosphere.

A hinge 152 is connected to the tubular sections 96 and 100 and permits pivotal movement therebetween when the hammer union disconnect 112 is manipulated to disconnect the tubular sections 96 and 98. This permits the delivery tube to be pivoted from the vertical position of FIG. 3 to a horizontal position to facilitate loading of chemical sticks into the stick storage unit 116. A hinge switch 154 connected to the central processor unit 88 indicates when the delivery tube is in the vertical position for operation or is in the horizontal position where operation should be discontinued.

Referring now to FIG. 4, a stationary plate 156 having a low friction upper surface 158 forms the bottom of the turret housing unit 116. A stick receiving opening 160 extends through the plate 156 and aligns with the open end 120 of the delivery tube 92. Spaced above the stationary plate and mounted on a rotatably mounted shaft 162, is a lower plate 164, and spaced above the lower plate 164 on the shaft 162 is a second upper plate 166. The upper plate 166 may be vertically adjusted along the shaft 162 to vary the spacing between the plates 166 and 164, and the shaft is driven by the drive motor 118 which is connected to the central processor unit by a control line 168.

The upper and lower plates 166 and 164 respectively are provided with aligned, spaced holes 170 and 172 which form sequential hole pairs each of which loosely receives a chemical stick 18. Each hole pair is rotatable into alignment over the opening 160 as the shaft 162 rotates, and the lower plate 164 is provided with a plurality of index slots 174 with one index slot being provided in alignment with each of the holes 172. A limit switch 176 mounted below the plate 164 engages the index slots as they pass by the limit switch to provide a position feedback signed to the central processor unit via a line 178. The limit switch may be aligned with the opening 160.

As a chemical stick 18 is moved into alignment over the opening 160, it contacts the switch actuator 180 for a switch 182 mounted on the stationary plate 156 and causes a signal to be sent by the switch 182 over a line 184 to the central processor unit.

A manual winch 186 is supported on a mounting unit 188 connected to the tubular section 96 opposite the hinge 152. The winch includes a cable 100 connected to the tubular section 190 and may be operated to move the chemical stick storage and delivery system between the vertical and horizontal positions.

The configuration of the sticks 18 which are loaded into the turret housing unit 116 is important, as these sticks are configured to operate effectively in combination with the rotating plates 164 and 166 to move over the stationary plate 156 and into the opening 160. With reference to FIG. 5, each chemical stick 18 includes an elongate, tubular body 192 having a diameter D which is slightly less than the diameter of the holes 170 and 172. The tubular body is formed with an outer layer 196 of water soluable polymer material or other water soluable material, and is filled with soap or various chemicals 198 which are in solid or gel form at ambient temperatures. The open bottom end of each chemical stick is closed by an arcuately shaped, domed closure 200 formed of plastic, water soluable polymer, water soluable paper, or other low friction material. This domed closure provides minimal contact with the low friction surface 158 of the stationary plate 156 and permits the chemical stick to move with minimum friction over the surface 158. Also the domed closure guides the lower end of the chemical stick into the opening 160. The use of the outer layer of soluable polymer material permits the chemical stick storage and delivery system to be used effectively all year round, for this outer layer stops problems caused by heat and humidity. soluable material, and is filled with soap or various chemicals 198 which are in solid or gel form at ambient temperatures. The open bottom end of each chemical stick is closed by an arcuately shaped, domed closure 200 formed of plastic, water soluable polymer, water soluable paper, or other low friction material. This domed closure provides minimal contact with the low friction surface 158 of the stationary plate 156 and permits the chemical stick to move with minimum friction over the surface 158. Also the domed closure guides the lower end of the chemical stick into the opening 160. The use of the outer layer of soluable polymer material permits the chemical stick storage and delivery system to be used effectively all year round, for this outer layer stops problems caused by heat and humidity.

Figure 6:
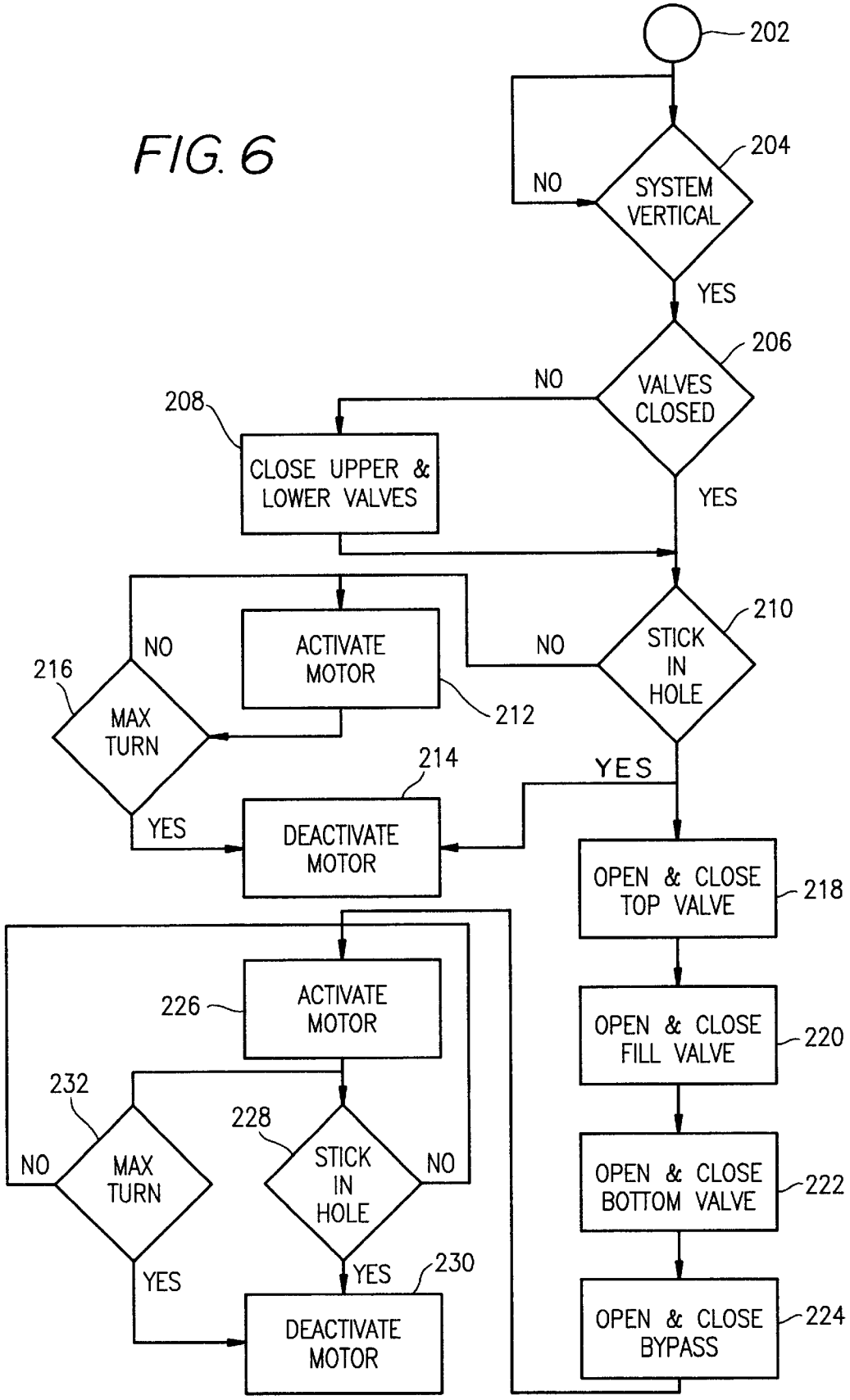
FIG. 6 is a flow diagram showing the operation of the central processor unit of FIG. 3.

Turning now to FIG. 6, the central processor unit 88 initiates a cycle of operation at 202 and then, by means of the hinge switch 154, checks at 204 to make sure that the chemical stick storage and delivery system is in the vertical position. With the chemical stick storage and delivery system in the vertical position, the central processor unit then checks at 206 by means of the sensor switches 136 and 138 to make certain that the upper valve 108 and lower valve 106 are both closed. If one or both upper and lower valves are found to be open, the central processor unit operates at 208 to activate one or both of the solenoid valves 130 and 132 to cause one or both of the air cylinders and pistons 122 and 126 to close their respective valve.

With the lower and upper valves 106 and 108 closed, the central processor unit checks at 210 by means of the switch 182 to determine if a chemical stick 18 is positioned in the opening 160. If the presence of a chemical stick is not sensed, the central processor unit activates the drive motor 118 at 212 to rotate the shaft 162 and plates 164 and 166, and as soon as a stick in position is sensed by the switch 182, the drive motor is deactivated at 214. The drive motor will remain active either until a stick is properly positioned in the opening 160, or until the central processor unit senses at 216 by means of the limit switch 176 and index slots 174 that a predetermined maximum number of hole pairs have passed over the opening 160. Generally this maximum number is one less than the total number of hole pairs in the plates 164 and 166, so if there are 34 hole pairs, the central processor unit will operate to deactivate the drive motor at 214 when it senses at 216 that 33 hole pairs have rotated over the opening 160.

With a chemical stick positioned in the opening 160, the central processor unit will make sure that the drive motor is deactivated at 214 and will open and close the top valve 108 at 218 by means of the solenoid valve 130 and air cylinder and piston 122 to drop the stick into the delivery tube section

100. The stick will pass through the normally open check valve 110 which operates to close as a safety valve in response to the resultant upward flow of gas through the delivery tube 92 if the lower and upper valves 106 and 108 should fail in the open position.

Once the chemical stick 18 is lodged in the delivery tube section 100, and the upper valve 108 has been reclosed, the central processor unit opens the fill valve 140 for a predetermined period at 220 before reclosing the fill valve. This permits filtered gas from the well head to pass into the delivery tube section 100 to equalize the pressure between the delivery tube and the well head. Once the pressure is equalized, the central processor operates at 222 to open and subsequently close the lower valve 106 to drop the chemical stick into the well head. This is achieved by activation of the solenoid valve 132 and air cylinder and piston 126. Now the bypass valve 150 is opened for a predetermined period to vent the gas pressure from the delivery tube and return the delivery tube to atmospheric pressure.

With the delivery tube at atmospheric pressure, the central processor unit again activates the drive motor at 226 and senses at 228 when a chemical stick is moved into the opening 160. With the chemical stick in place, the drive motor is deactivated at 230 and the system is ready for a new cycle of operation. However, if no chemical stick is sensed, the drive motor continues to rotate until the predetermined number of hole pairs passing over the opening 160 are sensed at 232 and then the drive motor is deactivated at 230.

What is claimed is:

1. A chemical stick storage and delivery system mountable on a well head for providing elongate chemical sticks in spaced sequence to a well comprising:

an elongate delivery tube mountable on said well head and having a first open end and a second open end spaced from said first open end, a chemical stick storage device mounted on said elongate delivery tube at the first open end thereof, said chemical stick storage device including a stationary base having a top surface with a stick receiving opening aligned with the first open end of said delivery tube, and a chemical stick mounting unit mounted above said stationary base to hold a plurality of spaced chemical sticks and operating to move chemical sticks sequentially over said top surface into alignment with said stick receiving opening, said chemical stick mounting unit including at least a rotatably mounted first stick receiving unit spaced above the top surface of said stationary base, said first stick receiving unit including a plurality of sequentially spaced chemical stick holders, each said chemical stick holder being formed to receive a chemical stick and to rotate with said first stick receiving unit to move a chemical stick over the top surface of the stationary base and into alignment over said stick receiving opening during rotation of said first stick receiving unit, a drive motor mounted on said chemical stick storage unit and connected to rotate said first stick receiving unit, a first position sensing unit mounted on said chemical stick storage device and operative to provide a first output, signal when a chemical stick is positioned in alignment over said stick receiving opening, a second position sensing unit mounted on said chemical stick storage device and operative to provide a second output signal each time a chemical stick holder passes by said second position sensing unit, and a central processor unit connected to receive said first and second output signals and to control said drive motor in response thereto.

2. The chemical stick storage and delivery system of claim 1 wherein said delivery tube includes at least a first section connectable to said well head and a second section extending from said first section to said chemical stick storage unit, and a hinge connecting said first and second sections to permit said second section to be pivoted relative to said first section to facilitate loading of chemical sticks into said chemical stick storage unit when said first section is connected to a well head.

3. The chemical stick storage and delivery system of claim 1 in combination with the chemical sticks wherein each chemical stick includes a tubular body filled with material to be dispensed in said well, one end of said tubular body being formed with an arcuate domed cap, said chemical stick holder operating to position each chemical stick in a plane substantially parallel to a central longitudinal axis for said delivery tube with said arcuate domed cap resting on said top surface of the stationary base.

4. The chemical stick storage and delivery system of claim 3 wherein the tubular body of said chemical stick is formed of liquid soluable material.

5. The chemical stick storage and delivery system of claim 3 wherein said rotatable chemical stick storage device includes a second stick receiving unit spaced above said top surface of said stationary base, said first stick receiving unit being positioned between said stationary base and said second stick receiving unit, said second stick receiving unit being formed to engage and guide chemical sticks received in the spaced chemical stick holders of said first stick receiving unit.

6. The chemical stick storage and delivery system of claim 5 wherein said second stick receiving unit is mounted for rotation with said first stick receiving unit, the first and second stick receiving units being provided with a plurality of spaced apertures extending therethrough, the apertures in said first and second stick receiving units being aligned to form aperture pairs, each aperture pair being formed to loosely receive a chemical stick, said first and second stick receiving units being mounted on a shaft which is mounted for rotation on said stationery base.

7. The chemical stick storage and delivery system of claim 6 wherein said delivery tube includes at least a first section connectable to said well head and a second section extending from said first section to said chemical stick storage unit, and a hinge connecting said first and second sections to permit said second section to be pivoted relative to said first section to facilitate loading of chemical sticks into said chemical stick storage unit when said first section is connected to a well head.

8. The chemical stick storage and delivery system of claim 6 wherein said second position sensing unit includes a plurality of switch actuators positioned on said chemical stick mounting unit, each of said switch actuators being positioned adjacent to an aperture pair and a limit switch connected to said central processor unit and mounted on said chemical stick storage unit to engage switch actuators passing by said limit switch during rotation of said first and second stick receiving units.

9. The chemical stick storage and delivery system of claim 8 wherein said first position sensing unit includes an electrical switch connected to said central processor unit, said electrical switch having a switch actuator which is actuated by contact with an object, said electrical switch being mounted with the switch actuator positioned to be contacted by a chemical stick positioned in alignment over said receiving opening.

10. The chemical stick storage and delivery system of claim 1 which includes a first valve assembly including a first valve mounted on said delivery tube adjacent to the first open end of the delivery tube to selectively open or close the delivery tube, a second valve assembly including a second valve mounted on said delivery tube in spaced relationship to said first valve adjacent to the second open end of the delivery tube to selectively open or close the delivery tube, said central processor unit being connected to said first and second valve assemblies to control said first and second valves.

11. The chemical stick storage and delivery system of claim 10 which includes a pressure equalization line having a first end for connection with said well head and a second end connected in communication with said delivery tube between said first and second valves, and a pressure equalization valve mounted in said pressure equalization line to open or close said pressure equalization line said central processor unit being connected to control the operation of said pressure equalization valve.

12. The chemical stick storage and delivery system of claim 11 which includes a pressure relief valve connected to said delivery tube between said first and second valves and operable between a closed position and an open position where said delivery tube is vented to atmosphere, said central processor unit being connected to control the operation of said pressure relief valve.

13. The chemical stick storage and delivery system of claim 12 wherein said rotatable chemical stick storage device includes a second stick receiving unit spaced above said top surface of said stationary base, said first stick receiving unit being positioned between said stationary base and said second stick receiving unit, said second stick receiving unit being formed to engage and guide chemical sticks received in the spaced chemical stick holders of said first stick receiving unit.

14. The chemical stick storage and delivery system of claim 13 wherein said second stick receiving unit is mounted for rotation with said first stick receiving unit, the first and second stick receiving units being provided with a plurality of spaced apertures extending therethrough, the apertures in said first and second stick receiving units being aligned to form aperture pairs, each aperture pair being formed to loosely receive a chemical stick, said first and second stick receiving units being mounted on a shaft which is mounted for rotation on said stationery base.

15. The chemical stick storage and delivery system of claim 14 wherein said second position sensing unit includes a plurality of switch actuators positioned on said chemical stick mounting unit, each of said switch actuators being positioned adjacent to an aperture pair and a limit switch connected to said central processor unit and mounted on said chemical stick storage unit to engage switch actuators passing by said limit switch during rotation of said first and second stick receiving units.

16. The chemical stick storage and delivery system of claim 15 wherein said first position sensing unit includes an electrical switch connected to said central processor unit, said electrical switch having a switch actuator which is actuated by contact with an object, said electrical switch being mounted with the switch actuator positioned to be contacted by a chemical stick positioned in alignment over said receiving opening.

17. The chemical stick storage and delivery unit of claim 16 in combination with the chemical sticks wherein each chemical stick includes an elongate, hollow body filled with material to be dispensed in said well, one end of said hollow body being formed with an arcuate, domed cap, each said aperture pair operating to position a chemical stick in a plane substantially parallel to a central longitudinal axis of said delivery tube with said arcuate domed cap resting on the top surface of the stationary base.

18. The chemical stick storage and delivery system of claim 17 wherein the tubular body of said chemical stick is formed of liquid soluable material.

19. A chemical stick storage and delivery system for providing elongate chemical sticks in sequence to a well comprising:

an elongate delivery tube having a first open end and a second open end spaced from said first open end, a first valve assembly mounted on said delivery tube and operating to selectively open or close said delivery tube at the first open end thereof, a second valve assembly mounted on said delivery tube and spaced from said first valve assembly and operating to selectively open or close said delivery tube, a chemical stick storage device mounted on said elongate delivery tube at the first open end thereof, said chemical stick storage device including a stationary base having a top surface with an opening aligned with the first open end of said delivery tube, a chemical stick mounting means rotatably mounted on said stationary base, said chemical stick mounting means operating to bold a plurality of spaced chemical sticks and being rotatable to move chemical sticks sequentially into said opening in alignment with said first open end of said delivery tube, a drive motor operating to rotate said chemical stick mounting means, a pressure equalization line having a first end for connection with said well head and a second end connected in communication with said delivery tube between said first and second valve assemblies, a pressure equalization valve mounted in said pressure equalization line to open or close said pressure equalization line, and a central processor unit connected to control the operation of said first and second valve assemblies, said pressure equalization valve and said drive motor.

20. The chemical stick storage and delivery system of claim 19 which includes a pressure relief valve connected to said delivery tube between said first and second valve assemblies and operable between a closed position and an open position where said delivery tube is vented to atmosphere, said central processor unit being connected to control the operation of said pressure relief valve.

* * * * *